US005255740A

United States Patent [19]

Talley

[11] Patent Number: 5,255,740

[45] Date of Patent: Oct. 26, 1993

[54] SECONDARY RECOVERY PROCESS

[75] Inventor: Robert R. Talley, Katy, Tex.

[73] Assignee: RRKT Company, Katy, Tex.

[21] Appl. No.: 867,420

[22] Filed: Apr. 13, 1992

[51] Int. Cl.[5] ..... E21B 43/24; E21B 43/34

[52] U.S. Cl. ..... 166/272; 166/266; 166/267; 166/302; 166/303

[58] Field of Search ..... 166/57, 59, 60, 260, 166/258, 266, 267, 272, 302, 303

[56] References Cited

U.S. PATENT DOCUMENTS

| | | | |
|---|---|---|---|
| 2,923,535 | 2/1960 | Ljungstrom | 166/258 X |
| 2,939,688 | 6/1960 | Pelzer | 166/303 X |
| 3,091,292 | 5/1963 | Kerr | 166/272 X |
| 3,233,670 | 2/1966 | Thompson et al. | 166/272 X |
| 4,344,486 | 8/1982 | Parrish | 166/266 X |
| 4,366,864 | 1/1983 | Gibson et al. | 166/266 X |
| 4,640,352 | 2/1987 | Vanmeurs et al. | 166/60 X |
| 4,744,417 | 5/1988 | Alameddine | 166/266 X |
| 4,886,118 | 12/1989 | Van Meurs et al. | 166/57 X |
| 4,926,941 | 5/1990 | Glandt et al. | 166/60 X |

*Primary Examiner*—George A. Suchfield
*Attorney, Agent, or Firm*—Bush, Moseley & Riddle

[57] ABSTRACT

In accordance with illustrative embodiments of the present invention, a process for the secondary recovery of oil found in a dolomite formation includes generating in-situ decomposition of the dolomite by heating it to a temperature in the range of from 1,400°-1,750° F. which produces a reaction that has magnesium and calcium oxides and a large quantity of carbon dioxide as products. The carbon dioxide saturates the oil in surrounding formations and makes it more movable toward one or more recovery wells. The heat is convected into the formation by a fluid that is injected into the well from the surface.

9 Claims, 1 Drawing Sheet

SECONDARY RECOVERY PROCESS

FIELD OF THE INVENTION

This invention relates generally to a secondary recovery process that enables production from an underground reservoir of oil that has been left in place either at the end of a primary recovery process, or as a result of natural migration processes, and particularly to a secondary recovery process where dolomite is heated to high temperatures to produce carbon dioxide that makes oil in the surrounding formations more movable toward one or more recovery wells.

BACKGROUND OF THE INVENTION

After oil has been removed from a subterranean dolomite reservoir by primary recovery methods such as water or gas drive or pumping or by natural migration, a very large amount of low saturation oil still remains in the formation. At this stage, it is fairly common to employ various secondary recovery measures in an effort to extract at least some of the remaining oil. One type of secondary recovery process that has been widely used is called "in-situ" combustion where a fire is started at the bottom of one well which burns carbonaceous reservoir materials (kerogen) in the rocks in the presence of an oxidizing medium such as air. Inherent in this process is the production of flue gas which includes carbon dioxide, nitrogen and carbon monoxide. Although it is generally recognized that carbon dioxide will make low saturation oil more movable by swelling the oil and lowering its viscosity, flue gas has a low efficiency respecting displacement of oil in the reservoir because the carbon dioxide is in a diluted form.

Various processes have been proposed to generate sufficient carbon dioxide in an in-situ combustion process that would make secondary recovery economically feasible. For example the Sharp U.S. Pat. No. 3,174,543 discloses in-situ combustion of natural reservoir materials together with introduction of a driving fluid which is miscible with the $Co_2$. The driving fluid, the gas phase and the oil are intended to be forced toward a production well. An electrical resistance heater is used to initiate burning at a temperature of about 500°. The Speller, Jr. U.S. Pat. No. 3,964,545 discloses the injection of air to cause an oxidation reaction with carbonaceous material in the formation to produce $CO_2$, which would make oil in the surrounding area more movable. Kamath U.S. Pat. No. 4,465,135 discloses injection of ozone and/or oxygen to support in-situ combustion which produces $CO_2$ that would increase the movability of the oil adjacent the fire front. Gilliland U.S. Pat. No. 3,408,082, although not directed to a secondary recovery process, proposes in-situ reporting of oil shale near the surface by injecting $CO_2$ which has been heated to a relatively high temperature at the surface. The combustion zone also is pressurized to a range of about 500–1,000 psi to avoid burning limestone and dolomite rocks. The Bridges et al U.S. Pat. No. 4,821,798 discloses an electrical heating system to increase the temperature of the oil and thereby reduce its viscosity. The casing strings are used as parts of the electrical circuit. The Gibson et al U.S. Pat. No. 4,336,864 proposes forming an underground, rubbilized cave between an injection well and a recovery well by burning limestone to create calcium oxide which then is contacted with water to produce a slurry of calcium hydroxide. The calcium hydroxide is then flushed out to create void spaces. Hydraulic fracturing or other means is employed to cause the remaining materials to cave in and form the rubbilized zone. Thus although production of $CO_2$ in various secondary recovery processes is known, most of these processes are aimed at liberating $CO_2$ by burning the natural kerogen materials or oil that remain in a reservoir rock after primary completion methods have been exhausted, or have reached their economic limit.

A general object of the present invention is to provide a new and improved secondary recovery process where dolomite rock in an oil bearing formation is subjected to a controlled heating to high temperatures to dissociate the same into other materials including $CO_2$ which makes the oil in surrounding rocks more movable.

SUMMARY OF THE INVENTION

This and other objects are attained in accordance with the concepts of the present invention through the provision of a secondary recovery process which includes heating a dolomite formation in-situ at high temperatures to cause an endothermic reaction that dissociates the dolomite into either MgO, or MgO and CaO, both of which are rocks, and large quantities of $CO_2$ gas. The $CO_2$ gas saturates the oil in surrounding rocks so that the oil will move toward one or more recovery wells where it and the $CO_2$ can be produced to the surface. At the surface, the $CO_2$ gas is separated from the oil and can be used to enhance oil recovery by injection into other wells in the area, vented to the atmosphere, or sold. In accordance with this invention, the dolomite rock is itself decomposed, rather than merely burning the kerogen and oil therein. The amount of $CO_2$ which is produced as a result of such decomposition is 10 to 60 times that which can be generated by merely burning the kerogen and oil. Thus the secondary recovery of oil in dolomite reservoirs is greatly enhanced as a result of the practice of the present invention.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
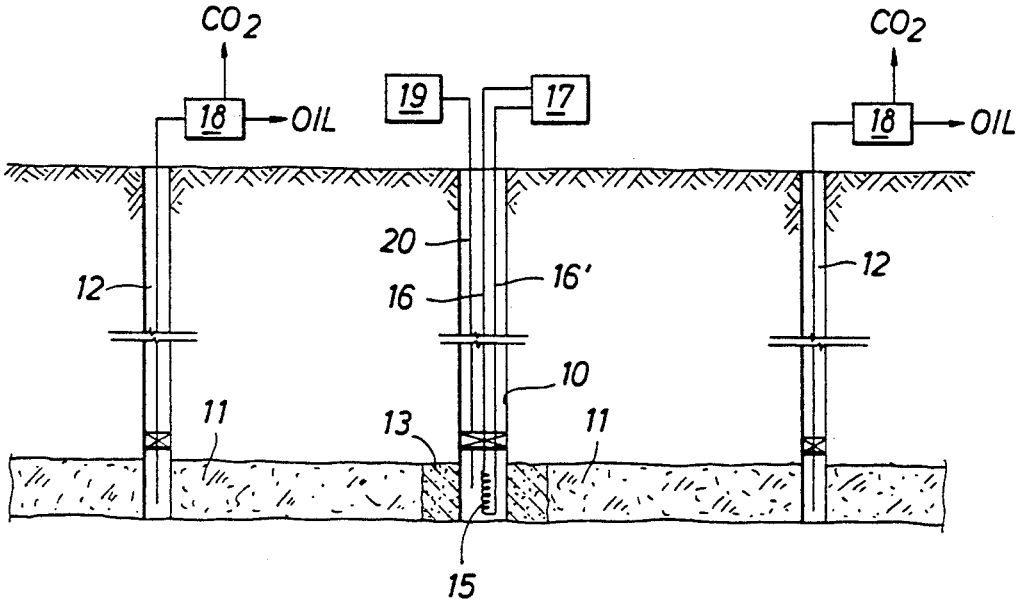
FIG. 1 is a schematic illustration of a well where the surrounding dolomite rock of the formation is heated, and which is spaced from several recovery wells.

With reference to FIG. 1, a well 10 where heating takes place extends from the earth's surface down to an oil bearing formation 11 composed mainly of dolomite which has the characteristic composition $CaMg(CO_3)_2$. The pores of the dolomite contains a significant quantity of oil which remains in place either after primary production processes have been exhausted, or as a result of natural oil migration processes. One or more laterally spaced recovery wells 12 also intersect the dolomite formation 11, and usually are located in a pattern that will optimize the recovery of oil therefrom in response to the heating which takes place in the well 10. The vertical thickness of the formation 11 where it crosses the well bore 10 defines the inner region of a heating zone 13.

Figure 2:
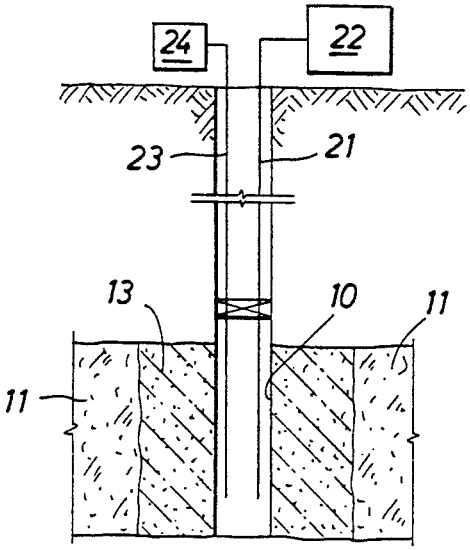
FIGS. 2 and 3 illustrate alternative ways of heating the dolomite to cause decomposition thereof.
Figure 3:
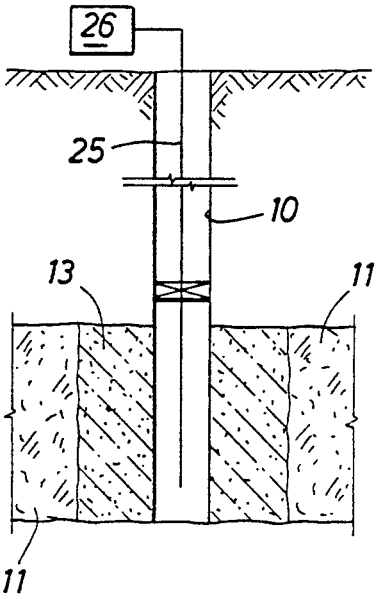

In order to generate an endothermic reaction which will decompose the dolomite in the zone 13, a temperature in the range of about 1,400°-1,750° is needed. This temperature can be reached in several ways. For example a resistance heater element 15 as shown in FIG. 1 can be placed in the well bore opposite the zone 13 and furnished with electrical current via conductors 16, 16' which are connected to an electrical power source 17 at the surface. Fluids such as air or water (steam), or both, which are injected at the surface by a compressor 19 through a pipe string 20 to the zone 13 are used to convect the heat into the zone 13. Another way to furnish heat is shown in FIG. 2. Here the heat is generated in the borehole 10 opposite the reaction zone 13, by injecting fuel down a pipe 21 using a pump 22. The fuel then is ignited by oxygen which, together with a heat conducting fluid such as steam or nitrogen, is pumped down a pipe 23 by suitable means 24. Supplemental heat which produces some $CO_2$ can be generated by combustion of carbonaceous materials in the formation by enriching the oxygen source beyond that required to burn the injected fuel. In FIG. 3, super-heated gases are injected down the wellbore 10 and into the zone 13 by a heater/compressor 26 and a pipe string 25. The choice of method will depend to some extent on the nature of the particular geographical area. In each example, the wells 10 and 25 usually are lined with steel casing that has been extensively perforated opposite the zone 13, and suitable packers can be used to isolate the casing thereabove from pressures in the pipe strings 20, 21, 23 and 25. Of course production strings of tubing typically are used in the recover wells 12, as shown.

The high temperatures which are generated in each example will decompose the dolomite rock and break it down into other components in accordance with the following chemical reactions:

$$CaMg(CO_3)_2 + heat \rightarrow MgO + CaCO_3 + CO_2 \quad (1)$$

or $$CaMg(CO_3)_2 + heat \rightarrow MgO + CaO + 2(CO_2) \quad (2)$$

The resulting magnesium and calcium oxides are rocks, whereas the $CO_2$ is dissociated gas. The $CO_2$ gas will travel radially outward of the zone 13 through the pore spaces in the dolomite rocks on account of their permeability, and will saturate the surrounding oil. Such saturation causes swelling to increase the pore saturation, so that the oil can migrate toward the recovery wells 12. At these wells the oil and $CO_2$ are pumped or otherwise recovered at the surface. The radial extent of the zone 13 will increase as decomposition progresses.

The production from each of the recovery wells 12 is passed through a separator 18 when the $CO_2$ gas is removed. The $CO_2$ then can be used to enhance the recovery of oil from other wells in the area, vented to the atmosphere, or sold. The borehole temperature at formation levels can be monitored by suitable means (not shown) in order to regulate both energy and distribution fluid injection rates. Such injection rates will change with time as the formation's properties change in with $CO_2$ dissociation, with naturally occurring spatial permeability charge, and with increasing radius of the heated zone.

To summarize the present invention and its use, on oil-bearing dolomite formation, from which the recovery of oil by primary methods is no longer, or never was, economically feasible, is heated under a controlled process to high temperatures in-situ, and fluids necessary to convect the heat into the formation are supplied. The resulting chemical reaction dissociates $CO_2$ in large quantities which saturates the oil in the surrounding formations. The amount of $CO_2$ available from the dissociation of dolomite is 10 to 60 times greater than that available from merely burning the carbonaceous materials contained in the rock, as has been done heretofore.

It now will be recognized that a new and improved secondary process for recovering oil from a dolomite formation has been disclosed. Since certain changes or modifications may be made in the disclosed embodiments without departing from the inventive concepts involved, it is the aim of the following claims to cover all such changes and modifications falling within the true spirit and scope of the present invention.

What is claimed is:

1. A method for enhancing the recovery of oil from a dolomite formation that is intersected by a well bore, comprising the steps of: heating the dolomite adjacent the well bore at a temperature in the range of from 1,400°-1,750° F. to produce an endothermic chemical reaction which has carbon dioxide as a reaction product: and allowing said carbon dioxide to saturate the oil in surrounding formations and thus make such oil more movable toward a recovery well.

2. A method for enhancing the recovery of oil from a dolomite formation that is intersected by a well bore, comprising the steps of: heating the dolomite adjacent the well bore at a temperature in the range of from 1,400°-1,750° F. to produce an endothermic chemical reaction which has carbon dioxide as a reaction product; and allowing said carbon dioxide to saturate the oil in surrounding formations and thus make such oil more movable toward a recovery well, said heating step being carried out by positioning an electrical resistance heater means in said well bore opposite said formation, applying electrical current to said heater means, and injecting a fluid which convects the heat generated by said heater means into said formation.

3. A method for enhancing the recovery of oil from a dolomite formation that is intersected by a well bore, comprising the steps of: heating the dolomite adjacent the well bore at a temperature in the range of from 1,400°-1,750° F. to produce an endothermic chemical reaction which has carbon dioxide as a reaction product; and allowing the carbon dioxide to saturate the oil in surrounding formations and thus make such oil more movable toward a recovery well, said heating step being carried out by injecting a combination of fuel, oxygen and a heat convecting fluid into said bore hole adjacent said formation to create a high temperature zone.

4. A method for enhancing the recovery of oil from a dolomite formation that is intersected by a well bore, comprising the steps of: heating the dolomite adjacent the well bore at a temperature in the range of from 1,400°-1,750° F. to produce an endothermic chemical reaction which has carbon dioxide as a reaction product; and allowing the carbon dioxide to saturate the oil in surrounding formations and thus make such oil more movable toward a recovery well, said heating step being carried out by injecting super-heated gases into said formation.

5. A method of enhancing the recovery of hydrocarbons from a dolomite formation that is intersected by a well bore, comprising the steps of: generating heat in a zone of the well bore opposite the dolomite formation at temperatures in the range of from 1,400°-1,750° F.; convecting said heat into the surrounding formations by injecting a fluid from the surface, and causing endothermic in-situ dissociation of said dolomite in response to said temperatures to create a reaction where the products of said dissociation are magnesium oxide, calcium oxide and $CO_2$ gas, said $CO_2$ gas saturating the hydrocarbons contained in said formation outward of said zone to thereby decrease the viscosity and increase the movability thereof.

6. The method of claim 5 wherein said convecting step is carried out by injecting a fluid such as air, steam or nitrogen.

7. A method of enhancing the recovery of hydrocarbons from a dolomite formation that is intersected by a well bore, comprising the steps of: generating heat in a zone of the well bore opposite the dolomite formation at temperatures in the range of from 1,400°-1,750° F.; convecting said heat into the surrounding formations by injecting a fluid from the surface, and causing endothermic in-situ dissociation of said dolomite in response to said temperatures to create a reaction where the products of said dissociation are magnesium oxide, calcium oxide and $CO_2$ gas, said $CO_2$ gas saturating the hydrocarbons contained in said formation outward of said zone to thereby decrease the viscosity and increase the movability thereof, said generating step being carried out by operating an electrical resistance heating means in the well bore adjacent said formation while injecting a fluid into said formation which effects said convecting step.

8. A method of enhancing the recovery of hydrocarbons from a dolomite formation that is intersected by a well bore, comprising the steps of: generating heat in a zone of the well bore opposite the dolomite formation at temperatures in the range of from 1,400°-1,750° F.; convecting said heat into the surrounding formations by injecting a fluid from the surface, and causing endothermic in-situ dissociation of said dolomite in response to said temperatures to create a reaction where the products of said dissociation are magnesium oxide, calcium oxide and $CO_2$ gas, said $CO_2$ gas saturating the hydrocarbons contained in said formation outward of said zone to thereby decrease the viscosity and increase the movability thereof, said generating step being carried out by supplying a fuel to said zone through a first pipe string, and supplying oxygen and a heat conducting fluid to said zone through a second pipe string.

9. A method of enhancing the recovery of hydrocarbons from a dolomite formation that is intersected by a well bore, comprising the steps of: generating heat in a zone of the well bore opposite the dolomite formation at temperatures in the range of from 1,400°-1,750° F.; convecting said heat into the surrounding formations by injecting a fluid from the surface, and causing endothermic in-situ dissociation of said dolomite in response to said temperatures to create a reaction where the products of said dissociation are magnesium oxide, calcium oxide and $CO_2$ gas, said $CO_2$ gas saturating the hydrocarbons contained in said formation outward of said zone to thereby decrease the viscosity and increase the movability thereof, said generating step being carried out by injecting super-heated gases into said zone.

* * * * *